United States Patent [19]

Steffes

[11] Patent Number: 5,064,088

[45] Date of Patent: Nov. 12, 1991

[54] PICNIC COOLER WITH LID HAVING INTEGRALLY MOLDED HINGE

[75] Inventor: William J. Steffes, Wichita, Kans.

[73] Assignee: Coleman Outdoor Products, Inc., Wichita, Kans.

[21] Appl. No.: 557,967

[22] Filed: Jul. 25, 1990

[51] Int. Cl.[5] ..... B65D 39/00

[52] U.S. Cl. ..... 220/339; 220/469

[58] Field of Search ..... 220/339, 3.1, 425, 469, 220/627

[56] References Cited

U.S. PATENT DOCUMENTS

| | | | |
|---|---|---|---|
| D. 305,490 | 1/1990 | Conley . | |
| 3,327,841 | 6/1967 | Schurman et al. | 220/469 X |
| 3,417,897 | 12/1968 | Johnson | 220/339 X |
| 3,441,071 | 4/1969 | Schurman et al. | 220/339 X |
| 3,542,235 | 11/1970 | Hidding | 220/339 |
| 3,551,940 | 1/1971 | Edison . | |
| 3,710,975 | 1/1973 | Jansen . | |
| 3,904,074 | 9/1975 | Hoffman | 220/339 |
| 3,933,296 | 1/1976 | Ruskin . | |
| 4,005,800 | 2/1977 | Schurman | 220/469 X |
| 4,060,173 | 11/1977 | Dahl . | |
| 4,143,695 | 3/1979 | Hoehn | 220/339 |
| 4,189,054 | 2/1980 | Liu . | |
| 4,243,140 | 1/1981 | Thrun . | |
| 4,293,079 | 10/1981 | Lytle | 220/339 X |
| 4,314,637 | 2/1982 | Posso . | |
| 4,368,817 | 1/1983 | Temesvary . | |
| 4,394,906 | 7/1983 | Hollenbeck . | |
| 4,428,497 | 1/1984 | Julius et al. | 220/339 |
| 4,463,869 | 8/1984 | Lewis | 220/339 X |
| 4,533,061 | 8/1985 | Herbst | 220/469 X |
| 4,553,692 | 11/1985 | Padovani . | |

*Primary Examiner*—Steven M. Pollard

[57] ABSTRACT

A picnic cooler or the container comprises an open-topped container body and a removable lid. The lid includes a hinge portion which extends across the lid and divides the lid into first and second lid portions which are hingedly attached. One of the lid portions is removably attached to the container body, and the other lid portion can pivot about the hinge to provide access to the container body.

3 Claims, 4 Drawing Sheets

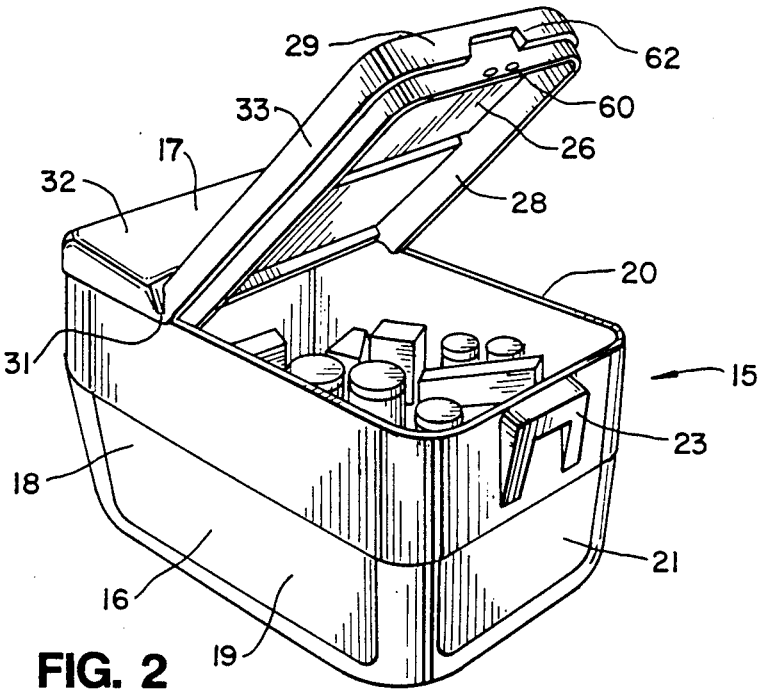
FIG. 2
FIG. 1
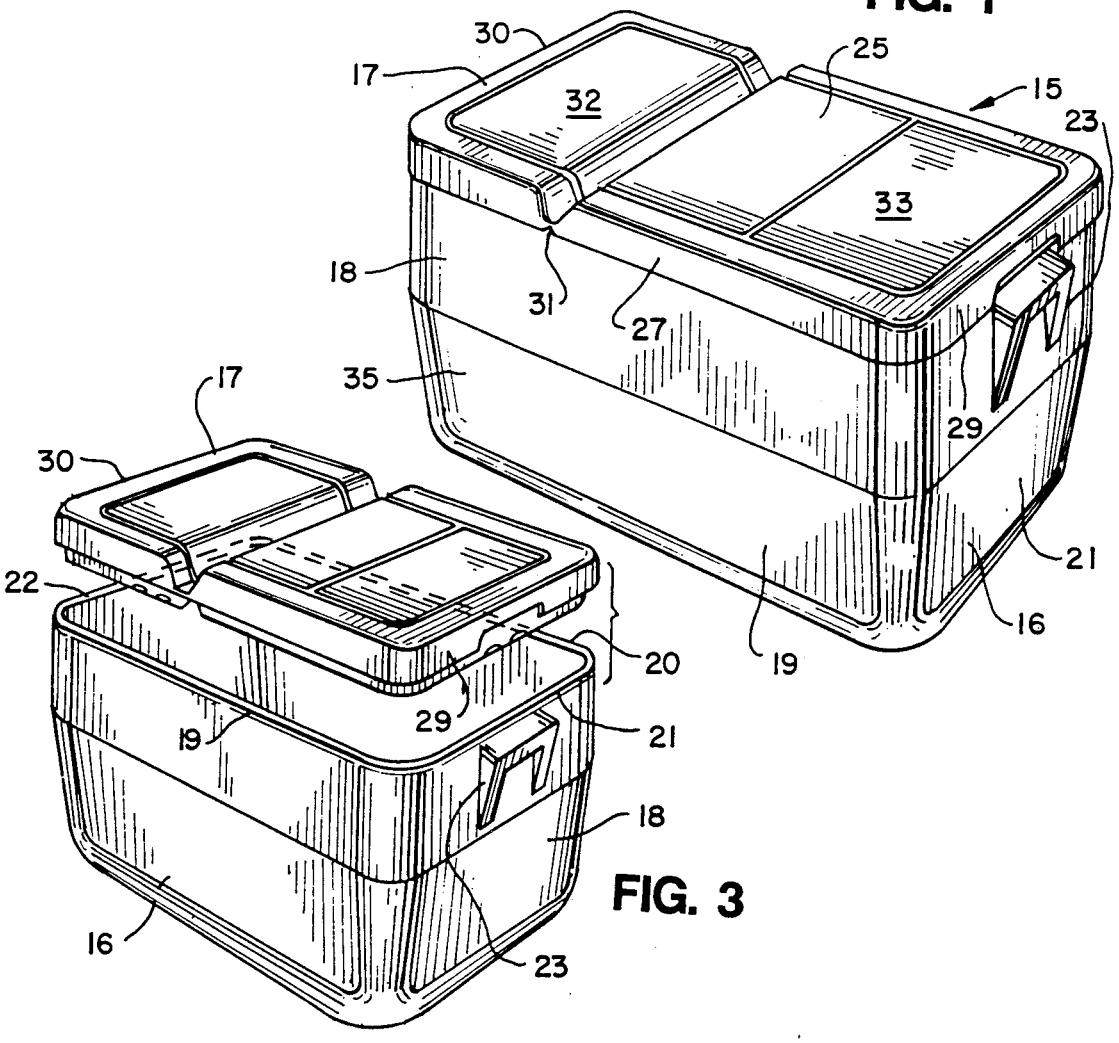
FIG. 3

FIG. 4
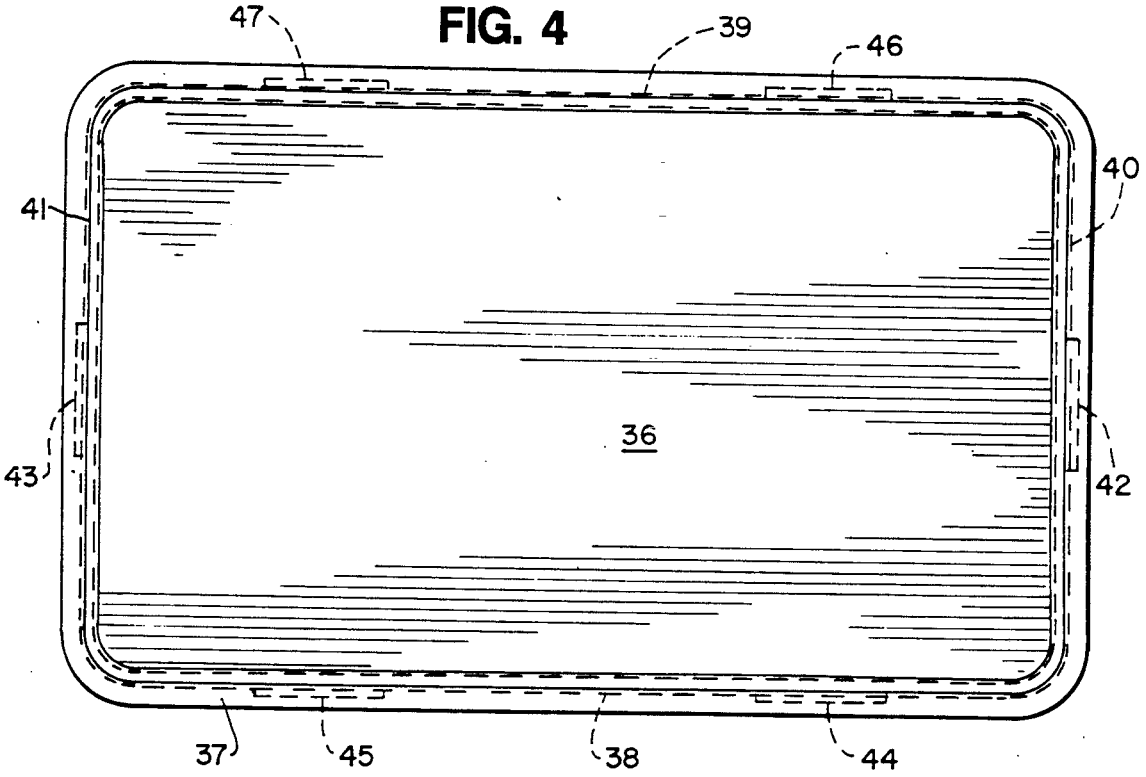
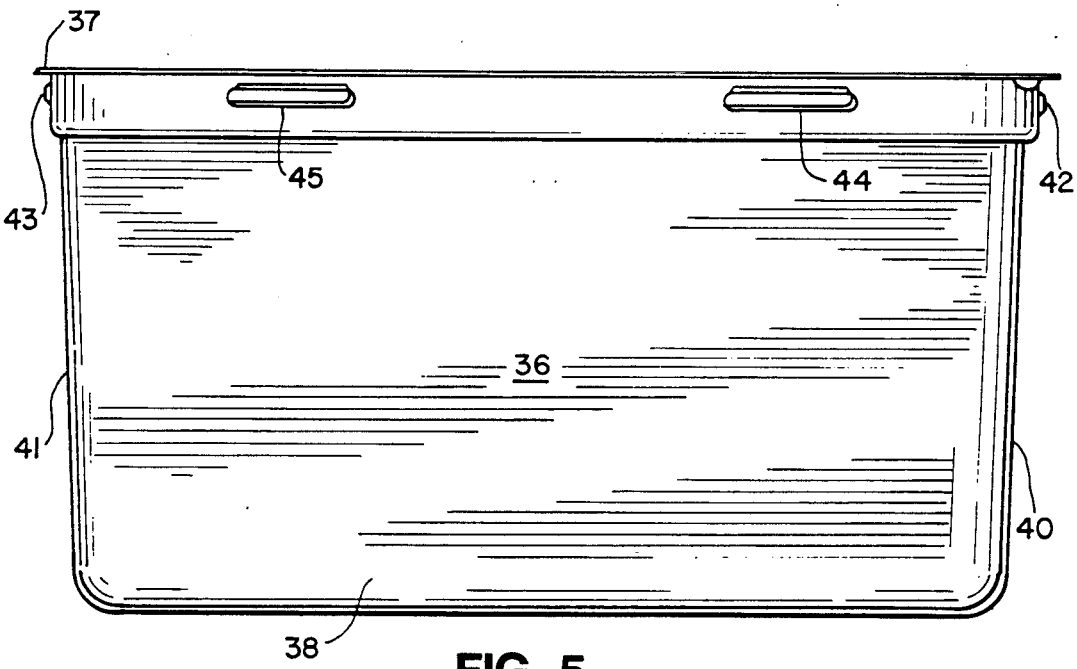
FIG. 5

FIG. 6
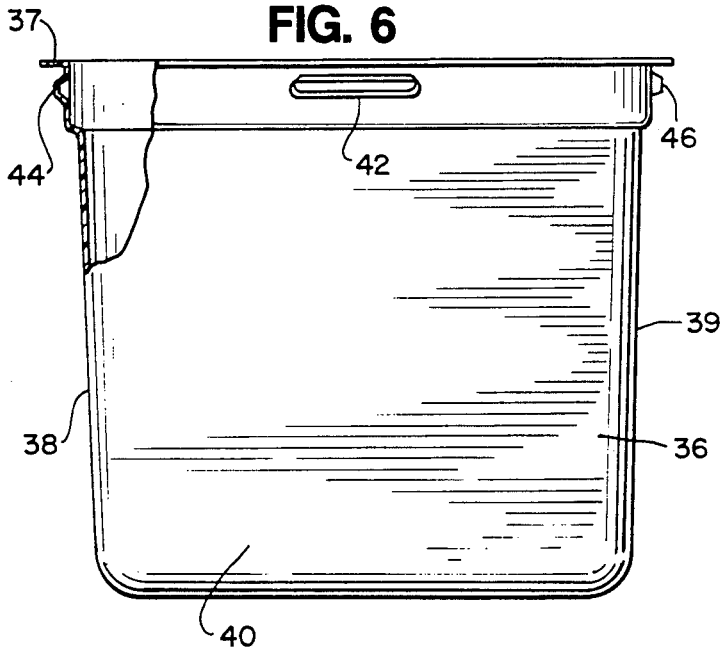
FIG. 7
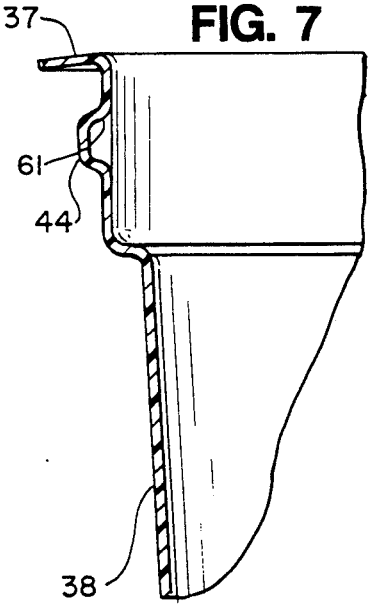
FIG. 8
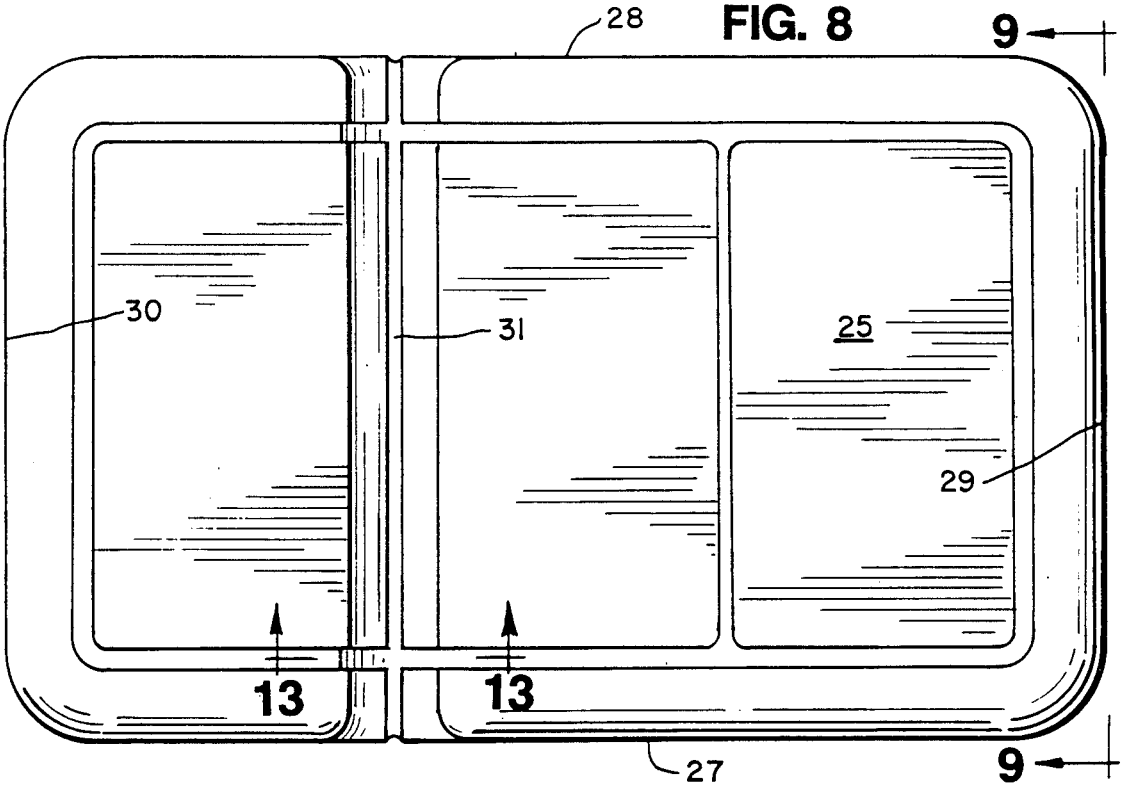
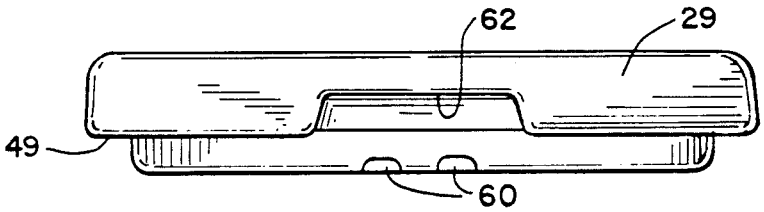
Fig. 9

PICNIC COOLER WITH LID HAVING INTEGRALLY MOLDED HINGE

BACKGROUND

This invention relates to storage containers such as picnic coolers, and, more particularly, to a storage container which includes a removable lid which has a hinge extending across the lid.

The invention will be explained in conjunction with a picnic cooler. However, it will be understood that the invention can be used with other types of storage containers.

Picnic coolers conventionally include an open-topped container body and a lid for closing the top of the container body. In some coolers the lid is permanently attached to the container by a hinge, and the lid pivots about the hinge. In other coolers the lid is completely removable. Both types of coolers have certain disadvantages.

A hinged lid generally requires additional costs for the hinges and the attaching hardward and for the labor for attaching the lid. The hinges are subject to breaking and are perceived by some customers as being a potential source of product failure. A permanently attached lid interferes with emptying the container and with cleaning the container and the lid. A lid which is completely removable from the container body can be lost or misplaced, and some consumers are reluctant to purchase a cooler with a removable lid for that reason.

Some old wicker or cane picnic baskets included a cover which covered a portion of the top of the basket and which was permanently attached to the basket. A lid was hingedly attached to the cover for closing the remainder of the top of the container. However, the cover was not removable from the basket, and the hinge was a conventional hinge which had to be attached to the cover and to the lid.

SUMMARY OF THE INVENTION

The invention provides a lid with an integrally molded hinge which divides the lid into two portions. One portion of the lid is removably attached to the container body, and the other portion can be pivoted about the hinge to provide access to the container. The lid with integrally molded hinge can be molded in substantially the same manner and at substantially the same cost as non-hinged lids, and no additional labor is required to assemble the lid to the container. The first portion of the lid snaps into locking engagement with the container, and the force required to detach the lid can be adjusted as desired by the manufacturer so that it will be detached only when the consumer wishes to remove it. The lid can be completely removed when desired by exerting sufficient force. The other portion of the lid can be provided with a latch which is engageable with the container for maintaining the hinged portion of the lid closed.

DESCRIPTION OF THE DRAWING

The invention will be explained in conjunction with an illustrative embodiment shown in the accompanying drawing, in which FIG. 1 is a perspective view of a picnic cooler which is formed in accordance with the invention;

FIG. 2 is a view similar to FIG. 1 showing the hinged portion of the lid open;

FIG. 3 is a perspective view of the picnic cooler with the lid removed;

FIG. 4 is a top plan view of the liner of the container body;

FIG. 5 is a side elevational view of the liner;

FIG. 6 is an end view, partially broken away, of the liner;

FIG. 7 is an enlarged fragmentary sectional view of the liner;

FIG. 8 is a top plan view of the lid;

FIG. 9 is an end view of the lid taken along the line 9—9 of FIG. 8;

DESCRIPTION OF SPECIFIC EMBODIMENT

Figure 10:
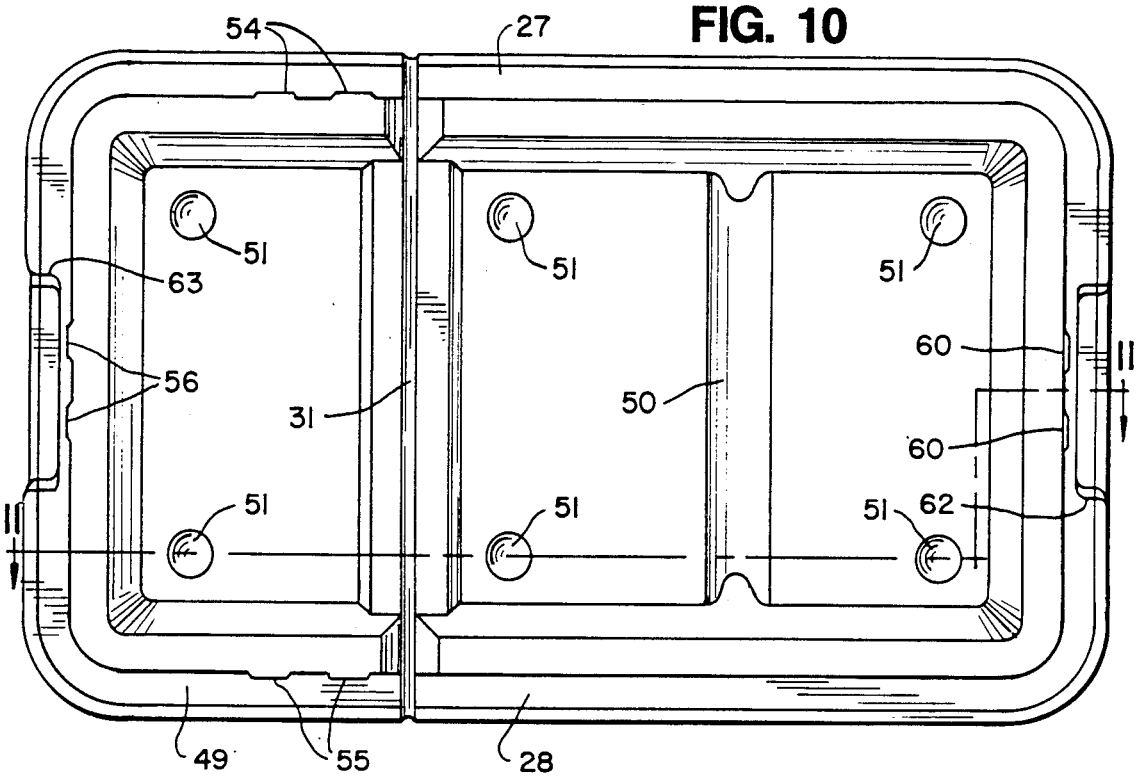
FIG. 10 is a bottom plan view of the lid.

Referring to FIGS. 1—3, the numeral 15 designates generally a picnic cooler which includes an open-topped container body 16 and a lid 17. The container body is generally rectangular and includes a bottom wall and a perimetric side wall 18. The side wall includes a pair of elongated side portions 19 and 20 and a pair of shorter end portions 21 and 22. A handle 23 is molded integrally with each of the end walls, but other types of handles can also be used.

The lid 17 is also rectangular and has essentially the same shape as the periphery of the upper edge of the container. The lid includes top and bottom walls 25 and 26, elongated side walls 27 and 28, and end walls 29 and 30. A hinge portion 31 extends across the lid between the side walls and divides the lid into first and second portions 32 and 33. As will be explained more fully hereinafter, the first portion 32 of the lid is removably attached to the container to prevent inadvertent removal of the lid. The second portion of the lid can pivot about the hinge 31 as illustrated in FIG. 2 to provide access to the container.

The container body may be formed in the conventional manner from a plastic outer shell 35 which is illustrated in FIGS. 1-3 and a plastic inner liner 36 which is illustrated in FIGS. 4-7. The liner 36 fits into the outer shell 35 and is supported by an outwardly extending lip or flange 37 which engages the top edge of the shell. The space between the outer shell and the liner is filled with insulating material such as foamed plastic.

The liner 36 includes a pair of side walls 38 and 39 and a pair of end walls 40 and 41 which correspond to the side walls 19 and 20 and end walls 21 and 22 of the container body. Outwardly extending horizontal recesses 42 and 43 are formed in the end walls 40 and 41, a pair of outwardly extending horizontal recesses 44 and 45 are formed in the side wall 38, and a pair of outwardly extending horizontal recesses 46 and 47 are formed in the side wall 39. Each of the recesses 44–47 is spaced approximately the same distance from the adjacent end wall of the liner.

Referring to FIGS. 8-13, the lid 17 is preferably molded by blow molding polyethylene. However, the lid could also be formed by injection molding or other techniques and could be made from different plastics. The top and bottom walls 25 and 26 are spaced-apart to provide the lid with a hollow interior, and the side walls 27 and 28 and the end walls 29 and 30 are provided with a horizontal shoulder 49 which is engageable with the top edge of the container. A transverse reinforcing embossment 50 extends upwardly from the bottom wall of the second portion 33 of the lid, and a plurality of circular reinforcing embossments 51 extend upwardly from the bottom wall of both the first and second portions 32 and 33.

The hinge portion 31 is formed during the molding process by a V-shaped trough 52 in the top wall 25 and a flexible plastic web 53 (FIG. 13) which is molded integrally with the top and bottom walls of the first and second portions 32 and 33 of the lid. In the preferred embodiment, the web 53 extends across the entire width of the lid to provide a durable hinge which can be flexed repeatedly throughout the expected life of the cooler without tearing. The side walls 27 and 28 extend upwardly in the hinge area to the web 53 so that the two lid portions 32 and 33 are joined only by the flexible web. The lid portions are therefore free to pivot relative to each other along the length of the web.

Figure 11:
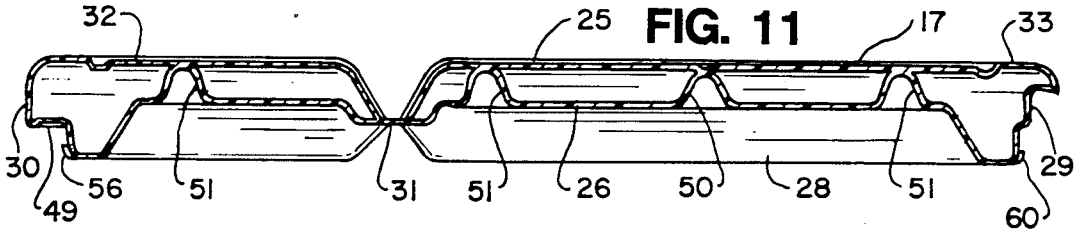
FIG. 11 is a sectional view of the lid taken along the line 11—11 of FIG. 10.
Figure 12:
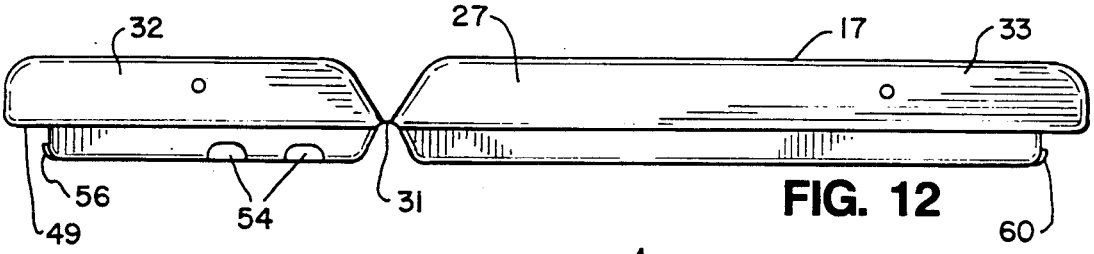
FIG. 12 is a side view of the lid.
Figure 13:
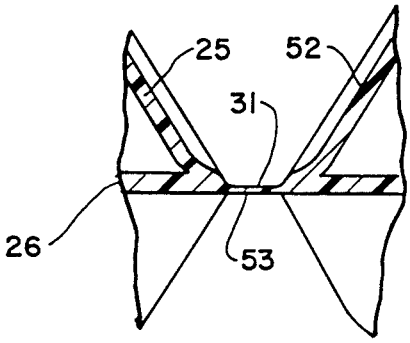
FIG. 13 is an enlarged fragmentary sectional view of the hinge portion of the lid.
Figure 14:
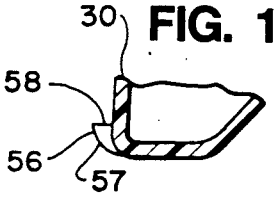
FIG. 14 is an enlarged fragmentary sectional view of one of the locking projections.

The first lid portion 33 is removably attached to the container by a plurality of projections on the lid which snap into the recesses in the liner of the container. Referring to FIGS. 10–12, a pair of projections 54 extend laterally outwardly from the side wall 27 below the shoulder 49, a pair of projections 55 extend laterally outwardly from the side wall 28, and a pair of projections 56 extend outwardly from the end wall 30. The projections are molded integrally with the lid portion 32. Referring to FIG. 14, each of the projections includes a curved bottom surface 57 and a substantially horizontal upper surface 58.

The projections 54–56 on the first lid portion 32 are sized and arranged to snap into the recesses 42–47 (FIG. 4) in the liner of the cooler. Since the side recesses 44–47 are spaced the same distance from the adjacent end wall, the first lid portion can be inserted into either end of the container. As the lid is forced downwardly into the container, the curved bottom surfaces 57 of the projections engage the inside surfaces of the liner and cam the projections inwardly and the liner outwardly. The molded walls of the lid and of the liner are sufficiently flexible to permit relative camming action therebetween. When the horizontal upper surfaces 58 reach the recesses, the projections snap into the recesses and retain the first lid portion on the container.

When the first portion of the lid is attached to the container, the second portion of the lid can pivot about the hinge 31 to provide access to the interior of the container as illustrated in FIG. 2. The hinged portion 33 of the lid is preferably longer than the first portion 32 of the lid to provide a large opening into the container when the hinged portion is raised.

The hinged portion 33 of the lid can be latched in a closed position by a pair of latch projections 60 (FIGS. 9–12) on the end wall 29. The projections 60 are similar to the projections 54–56 on the first lid portion 32 except that the projections 60 are not as big and therefore do not provide as much holding force. The projections 60 snap into the recess 42 or 43 in the end wall of the liner. The second lid portion 33 can be opened by exerting sufficient upward force on the second lid portion to force the projection 60 out of the recess. The first lid portion 32 will remain attached to the container as the second lid portion pivots upwardly.

The lid can be completely removed from the container by exerting sufficient upward force on the first lid portion 32 to cam the projections 54–56 out of the recesses and the liner. Referring to FIG. 7, each of the recesses includes an inclined top surface 61 which permits the camming action when sufficient force is exerted. The amount of force which is required to remove the first portion of the lid or to open the second portion of the lid can be adjusted by the manufacturer by varying the sizes of the projections 54–56 and 60.

A hand recess 62 (FIGS. 2 and 9) is provided in the end wall 29 to facilitate opening the second lid portion 33. A similar hand recess 63 (FIG. 10) is provided in the first lid portion 32 to facilitate removing the lid from the container.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A container comprising an open-topped generally rectangular container body having a bottom wall, a pair of generally parallel side walls, and a pair of generally parallel end walls extending between the side walls, and a removable lid for closing the top of the container body, the lid being integrally blow molded from plastic and being generally rectangular and having a pair of elongated generally parallel side walls and a pair of generally parallel end walls extending between the side walls and a hinge portion which extends across the lid between the side walls and divides the lid into first and second lid portions which are hingedly attached, each of said first and second lid portions having spaced-apart top and bottom walls and a side wall which connects the top and bottom walls, said hinge portion comprising a web of integrally molded plastic extending between the first and second lid portions, and attaching means on the container body and on the first lid portion for removably attaching the first lid portion to the container body whereby the second lid portion can be pivoted about the hinge portion to provide access to the container body without removing the first lid portion from the container body, and latch means on the container body and on the second portion for releasably latching the second lid portion to the container body.

2. The container of claim 1 in which the attaching means on the container body and on the first lid portion are provided by recesses in one of the end walls of the container body and in the side walls of the container body adjacent said one end wall and by a projection on the end wall of the first lid portion and by a projection on each of the side walls of the first lid portion, the projections being sized and adapted to extend into the recesses.

3. The picnic cooler of claim 1 in which each of the end walls of the container body is provided with a recess and each of the side walls of the container body is provided with a recess adjacent each of the end walls, each of the recesses in the side wall being located the same distance from the adjacent end wall, said attaching means on the container body being provided by the recess in one of the end walls of the container body and by the recesses in the side walls of the container body which are adjacent to said one end wall, said latch means on the container body being provided by the recess in the other end wall of the container body, said attaching means on the first lid portion being provided by a projection on the end wall of the first lid portion and by a projection on each of the side walls of the first lid portion, the projections being sized and arranged to extend into the recesses in the container body at each end of the container body, said latch means on the second lid portion being provided by a projection on the end wall of the second lid portion which is sized and adapted to extend into the recess on either end wall of the container body whereby the first lid portion can be removably attached to either end of the container body and the second lid portion can be releasably latched to either end of the container body.

* * * * *

UNITED STATES PATENT AND TRADEMARK OFFICE

CERTIFICATE OF CORRECTION

PATENT NO. : 5,064,088

DATED : November 12, 1991

INVENTOR(S) : William J. Steffes

It is certified that error appears in the above-identified patent and that said Letters Patent is hereby corrected as shown below:

Col. 4, line 57 change "picnic cooler" to --container--.

Signed and Sealed this

Twenty-third Day of February, 1993

*Attest:*

STEPHEN G. KUNIN

*Attesting Officer*

*Acting Commissioner of Patents and Trademarks*